US006170397B1

(12) United States Patent
Sanford

(10) Patent No.: US 6,170,397 B1
(45) Date of Patent: Jan. 9, 2001

(54) ENERGETIC TRANSMISSION LINE COMPLETION/INTERRUPTION MECHANISM

(75) Inventor: Matthew J. Sanford, Bel Alton, MD (US)

(73) Assignee: The United States of America as represented by the Secretary of the Navy, Washington, DC (US)

( * ) Notice: Under 35 U.S.C. 154(b), the term of this patent shall be extended for 0 days.

(21) Appl. No.: 09/136,975

(22) Filed: Aug. 20, 1998

(51) Int. Cl.[7] ..... F42C 15/34
(52) U.S. Cl. ..... 102/255; 102/254
(58) Field of Search ..... 102/255, 254

(56) References Cited

U.S. PATENT DOCUMENTS

| | | | | |
|---|---|---|---|---|
| 3,165,059 | * | 1/1965 | Saunders . | |
| 3,285,177 | * | 11/1966 | Lohmann . | |
| 3,500,747 | * | 3/1970 | Parker . | |
| 3,938,443 | | 2/1976 | Wolski | 102/76 P |
| 4,099,466 | * | 7/1978 | Redmond et al. . | |
| 4,337,702 | | 7/1982 | Betts | 102/254 |
| 4,478,147 | * | 10/1984 | Hennings et al. . | |
| 4,691,635 | | 9/1987 | Winterhalter et al. | 192/251 |
| 4,876,960 | * | 10/1989 | Schillinger et al. . | |
| 5,016,532 | * | 5/1991 | Edminster . | |
| 5,594,195 | | 1/1997 | Lenko et al. | 102/260 |
| 5,693,906 | | 12/1997 | Van Sloun | 102/251 |

FOREIGN PATENT DOCUMENTS

| | | | | |
|---|---|---|---|---|
| 427862 | * | 5/1938 | (BE) | 102/254 |
| 89547 | * | 5/1967 | (FR) | 102/254 |

* cited by examiner

*Primary Examiner*—Michael J. Carone
*Assistant Examiner*—Daniel J. Beitey
(74) *Attorney, Agent, or Firm*—James B. Bechtel, Esq.; Peter J. Van Bergen, Esq.

(57) ABSTRACT

A control mechanism is provided for coupling/interrupting two transmission leads. A first cam configured for spring-loaded rotation in a direction of rotation is positioned between the two leads. A lead coupler attached to the first cam couples the two leads to one another when the first cam achieves a prescribed position. A second cam is disposed adjacent to the first cam for, in sequential fashion, i) maintaining the first cam in a first position different than the prescribed position prior to rotation of the second cam, ii) permitting the spring-loaded rotation of the first cam from the first position to the prescribed position after rotation of the second cam commences, iii) inhibiting the spring-loaded rotation of the first cam from the prescribed position for a prescribed period of time during continued rotation of the second cam, and iv) permitting the spring-loaded rotation of the first cam from the prescribed position during continued rotation of the second cam after completion of the prescribed period of time.

17 Claims, 1 Drawing Sheet

ENERGETIC TRANSMISSION LINE COMPLETION/INTERRUPTION MECHANISM

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to mechanisms used to complete/interrupt a transmission line capable of transmitting electricity or an explosive reaction, and more particularly to a simple mechanical device that only completes such a transmission line during a prescribed window of time and assures that the transmission line is interrupted at all other times.

BACKGROUND OF THE INVENTION

In many explosive devices, detonation must occur at a particular time in a prescribed sequence of events. Should some malfunction occur during the prescribed sequence of events, it may be desirable to prevent detonation from every occurring thereby permanently "safing" the malfunctioned device. For example, underwater explosive devices are often placed in a shallow-water environment to clear a military landing zone. Typically, not all devices explode at time of detonation. To prevent later inadvertent detonation, unexploded devices are preferably removed from the zone. It is desirable to have confidence that any unexploded devices can be safely retrieved/removed from the area without harm to personnel. Accordingly, many fuze systems incorporate complex electronic or electromechanical components for completing a detonation train only at the appropriate time in a prescribed sequence of events. However, the complex or electric nature of such components are often the source of malfunction in harsh water environments.

SUMMARY OF THE INVENTION

Accordingly, it is an object of the present invention to provide a device that can be used to complete a detonation train at a prescribed time.

Another object of the present invention is to provide a device that completes a detonation train at a prescribed time and subsequently interrupts the detonation train such that detonation can only occur at the prescribed time.

Still another object of the present invention is to provide a simple mechanical device that can be used to complete a detonation train.

Other objects and advantages of the present invention will become more obvious hereinafter in the specification and drawings.

In accordance with the present invention, a control mechanism has a first cam configured for spring-loaded rotation in a direction of rotation. The first cam is positioned between two leads which can conduct an energetic transmission therealong when coupled to one another. A lead coupler made of a material capable of conducting the energetic transmission is coupled to the first cam. The lead coupler is sized and shaped such that the two leads are coupled to one another by the lead coupler when the first cam achieves a prescribed position. A second cam configured for rotation is disposed adjacent to the first cam for, in sequential fashion, i) firstly maintaining the first cam in a first position different than the prescribed position prior to rotation of the second cam, ii) secondly permitting the spring-loaded rotation of the first cam from the first position to the prescribed position after rotation of the second cam commences, iii) thirdly inhibiting the spring-loaded rotation of the first cam from the prescribed position for a prescribed period of time during continued rotation of the second cam, and iv) fourthly permitting the spring-loaded rotation of the first cam from the prescribed position during continued rotation of the second cam after completion of the prescribed period of time. A cam rotator is coupled to the second cam for rotating same.

DETAILED DESCRIPTION OF THE INVENTION

Figure 1:
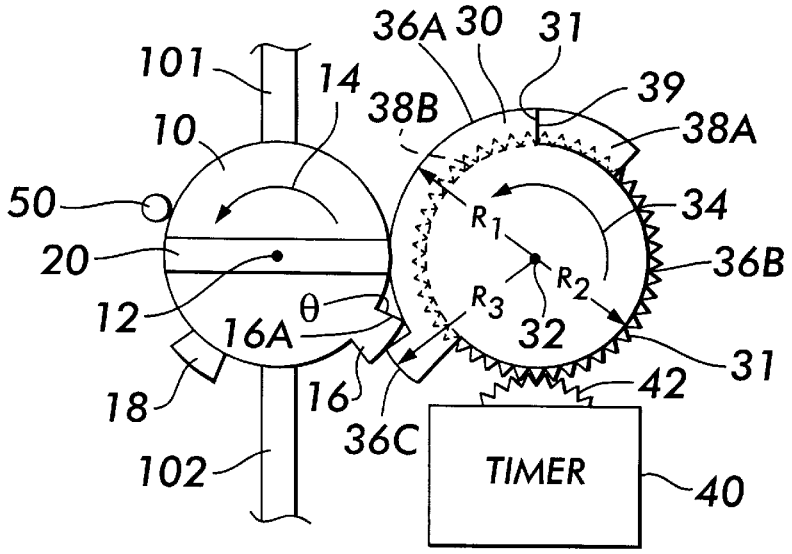
FIG. 1 is a plan schematic view of the energetic transmission line coupler/interrupter control mechanism of the present invention shown in its pre-detonation safe position.
Figure 2:
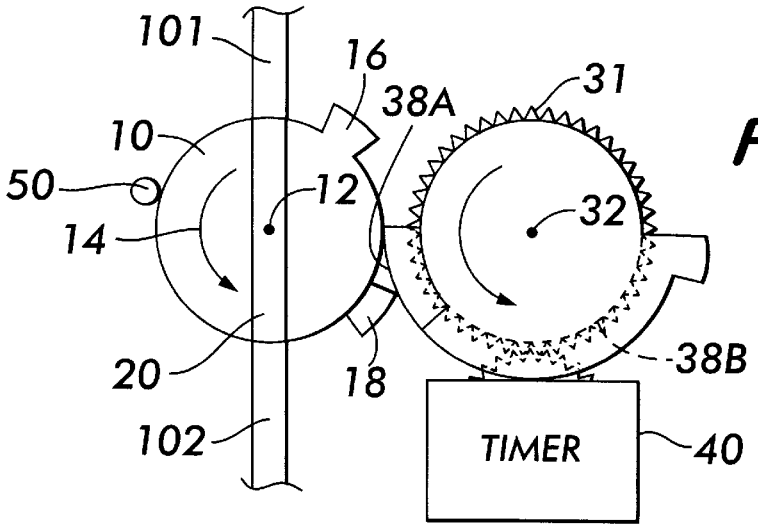
FIG. 2 is a plan schematic view of the control mechanism of the present invention shown in its detonation position.
Figure 3:
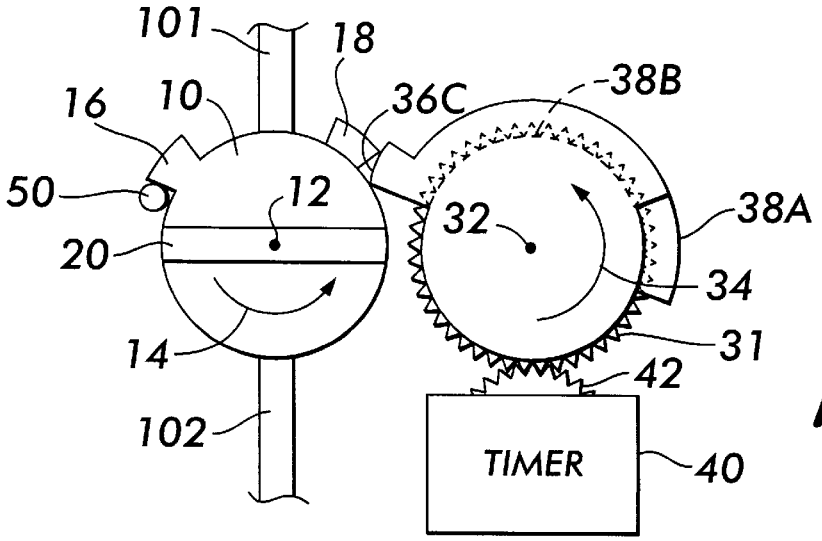
FIG. 3 is a plan schematic view of the control mechanism of the present invention shown in its post-detonation safe position.

Referring now to the drawings, FIGS. 1–3 depict an embodiment of an energetic transmission line coupler/interrupter control mechanism of the present invention at three positions during its sequence of operation. By way of example, the present invention will be described for its use in coupling and subsequently interrupting a detonation train. More specifically, the present invention will be used to couple two detonation leads 101 and 102 to one another at a precise time to allow an energetic (e.g., explosive) transmission to travel therealong (i.e., from lead 101 to lead 102 or vice versa) between other components of a fuze (not shown). However, leads 101 and 102 could also be electrical leads in which case the present invention could be configured to couple leads 101 and 102 to allow an electrical transmission to travel therealong.

Before describing the operation of the present invention, its component parts will first be described. Common reference numerals will be used for all views of the present invention. A first rotatable member or cam 10 is positioned between leads 101 and 102. Cam 10 is rotatable about its central axis 12 and is spring-loaded for rotation in one of a clockwise or counterclockwise direction of rotation. For clarity of illustration, the spring used to load cam 10 is not shown. However, the spring-loading is illustrated by arrow 14 which, in the illustrated embodiment, is configured for counterclockwise spring-loading. That is, if and when cam 10 is unrestrained, cam 10 will rotate counterclockwise about axis 12 brought about by spring-loading 14. The choice of spring can be selected based on the application and/or the amount of spring-loading needed. Examples of suitable springs could include coil springs used in clock mechanisms.

Cam 10 is essentially circular with protuberances or tabs 16 and 18 extending therefrom. Tab 16 lies in a first plane that is perpendicular to a axis 12. Tab 18 lies in a second plan (i.e., further into the paper) parallel to the plane in which tab 16 resides. For ease of description, it will be assumed that tabs 16 and 18 are similarly sized in terms of how far they extend radially from cam 10. While the exact shape and size of tabs 16 and 18 can be other than shown, the angle θ made between a side (e.g., side 16A of tab 16) of a tab and the adjoining periphery of cam 10 is typically 90° or less for reasons that will be apparent below. Tabs 16 and 18 are further angularly offset with respect to one another such that tab 16 will lead tab 18 during rotation of cam 10 brought about by spring-loading 14.

Mounted on or attached to cam 10 is a lead 20 that will be used to couple leads 101 and 102 to one another only when cam 10 is appropriately positioned. For the illustrated embodiment, lead 20 is made form a material that conducts an explosive reaction. If, however, leads 101 and 102 are electrical leads, lead 20 is made from a material that conducts electricity. To prevent the inadvertent "jumping" of any energetic transmission across cam 10, the material used to construct cam 10 should not be conductive of such energetic transmission. Note that although lead 20 is illustrated linearly, this need not be the case. Lead 20 can be sized and shaped to conform to a size and position necessary to couple leads 101 and 102 to one another when cam 10 is appropriately positioned. For a linear lead 20 that is initially positioned 90° out of alignment with a linear arrangement of leads 101 and 102, tabs 16 and 18 are angularly offset from one another by 90°.

Adjacent to cam 10 is a rotatable controlling member or cam 30. Cam 30 is rotatable about its central axis 32 and is used to control both the inhibition and release of spring-loading 14 thereby controlling rotational movement of cam 10. Rotational movement of cam 30 is indicated by arrow 34 which is in the same direction (e.g., counterclockwise) as spring-loading 14. Similar to cam 10, cam 30 is essentially circular and presents controlling peripheral surfaces on each of two planes that are parallel to one another and perpendicular to axis 22. The two controlling peripheral surfaces cooperate with tabs 16 and 18. Accordingly, a first controlling peripheral surface of cam 30 resides on a plane that is coincident with the plane in which tab 16 resides. The second controlling peripheral surface of cam 30 resides on a plane that is coincident with the plane in which tab 18 resides.

The first controlling surface of cam 30 residing on the plane coincident with tab 16 is defined in the illustrated example by three contiguous regions 36A, 36B and 36C, each of which is defined by a constant radius. Specifically, region 36A is defined by constant radius $R_1$, region 36B is defined by a constant radius $R_2$ and region 36C is defined by a constant radius $R_3$ where $R_3>R_1>R_2$. Radius $R_1$ is selected such that region 36A can only contact cam 10 at tab 16 as region 36A and tab 16 oppose one another as will be explained further below. Radius $R_2$ is selected such hat region 36B will not contact any portion of cam 10 (including tab 16) as it rotates. With respect to the direction of rotation 34, region 36A leads region 36B which leads region 36C.

The second controlling surface of cam 30 residing on the plane coincident with tab 18 is defined in the illustrated example by two contiguous regions 38A and 38B, each of which is defined by a constant radius. In the illustrated example, region 38A is defined by a constant radius equal to $R_1$ and region 38B, which defines the remainder of the second controlling surface, is defined by a constant radius equal to (or less than) $R_2$. When viewed relative to the direction of rotation 34, the leading edge 39 of region 38A is coincident with the trailing edge 37 of region 36A.

A variety of mechanisms can be used to rotate cam 30 thereby control rotation of cam 10 as brought about by spring-loading 14. By way of example, rotation of cam 30 is accomplished by the combination of a simple spring and mechanical timer. The spring (not shown for clarity of illustration) can be, for example, a simple coil or clock spring coupled to cam 30 for spring-biasing cam 30 to rotate in the direction of rotation 34. To control the release of the spring force in the direction of rotation 34, a mechanical timer 40 is coupled to cam 30 by, for example, gear tooth engagement. That is, gear teeth 42 of timer 40 mesh with gear teeth 31 on cam 30. Gear teeth 31 reside on a plane parallel to and spaced apart from the first controlling surface (defining regions 36A, 36B and 36C) and the second controlling surface (defined by regions 38A and 38B).

In operation, cam 10 is positioned with lead 20 out of alignment with leads 101 and 102 while cam 30 is positioned to maintain the position of cam 10, i.e., inhibit release of spring-loading 14. To do this, cam 30 is spring-loaded for the direction of rotation 34 with region 36A engaging tab 16 as illustrated in FIG. 1. The spring-bias of cam 30 in the direction of rotation 34 is initially restrained by, for example, the non-movement of gear teeth 42. Alternatively, gear teeth 42 could be configured for continual rotation and a mechanical stop (not shown) could be used to inhibit such rotation to thereby inhibit the spring-bias of cam 30.

When timer 40 is activated so that gear teeth 42 move clockwise, cam 30 begins to rotate counterclockwise with region 36A continuing to engage tab 16 to prevent the release of spring-loading 14. As region 36A rotates past tab 16, spring-loading 14 is released as tab 16 opposes region 36B of radius $R_2$ thereby allowing cam 10 to quickly assume counterclockwise rotation. When lead 20 has rotated 90° so that it is in alignment with and couples leads 101 and 102, tab 18 engages region 38A as illustrated in FIG. 2 to again inhibit the release of spring-loading 14. In this way, cam 10 snaps into alignment with leads 101 and 102. Meanwhile, the shapes of tab 18 and regions 38A allow for the continued rotation of cam 30 in the direction of rotation 34. The arc length of region 38A determines how long lead 20 stays in alignment with leads 101 and 102. That is, region 38A defines the prescribed window of time during which an explosive reaction (or electricity as the case may be) can travel from lead 101 and lead 102 or vice versa.

As the trailing edge of region 38A rotates past tab 18, spring-loading 14 is again released as tab 18 opposes region 38B of radius $R_2$. Thus, cam 10 again quickly assumes counterclockwise rotation to snap lead 20 out of coupled alignment with leads 101 and 102. For the linear arrangement of leads 101 and 102, lead 20 is preferably moved to a position that is 90° out of alignment with leads 101 and 102 as illustrated in FIG. 3. This minimizes the possibility that any energetic transmission could "jump" between leads 101 and 102 using lead 20.

To positively inhibit spring-loading 14 once lead 20 is rotated out of alignment, a mechanical stop can be provided to cooperate with one or both of tabs 16 and 18. In the illustrated embodiment, a single mechanical stop 50 is provided to engage tab 16 to prevent any further counterclockwise rotation of cam 10 as illustrated in FIG. 3. The above-described angle θ that tab 16 makes with the adjoining periphery of cam 10 allows tab 16 to positively engage stop 50. Cam 30 continues to rotate in the direction of rotation 34 until region 36C contacts cam 10 at which point timer 40 is stopped.

The advantages of the present invention are numerous. A simple mechanical control mechanism allows two energetic transmission lines to only be coupled during a prescribed window of time. Before and after this window, the mechanism assures that the lines are not coupled to one another to prevent any inadvertent energy transmissions. The mechanism will be of great use in explosive systems that may need to be retrieved should they malfunction during the prescribed window of time.

Although the invention has been described relative to a specific embodiment thereof, there are numerous variations and modifications that will be readily apparent to those skilled in the art in light of the above teachings. For example, the shape and material used for lead 20 can be changed for a particular application. The angular spacing between tabs 16 and 18 could also be changed. Similarly, the arc lengths of the various controlling surface regions of cam 30 could be changed. For example, the arc length of region 38A could be increased to increase the window of time during which leads 101 and 102 are coupled to one another. Still further, rotation of cam 30 might be controlled by a single device, e.g., just a mechanical timer, if spring-loading 14 was a weak force that could be controlled by the rotational force delivered by the mechanical timer. Note also that the direction of rotation for each of cams 10 and 30 could be clockwise. It is therefore to be understood that, within the scope of the appended claims, the invention may be practiced other than as specifically described.

What is claimed as new and desired to be secured by Letters Patent of the United States is:

1. A control mechanism, comprising:

a first cam configured for spring-loaded rotation in a direction of rotation, said first cam positioned between two leads which can conduct an energetic transmission therealong when coupled to one another;

a lead coupler made of a material capable of conducting said energetic transmission, said lead coupler coupled to said first cam, said lead coupler sized and shaped such that said two leads are coupled to one another by said lead coupler when said first cam achieves a prescribed position;

a second cam configured for rotation and disposed adjacent to said first cam for firstly maintaining said first cam in a first position different than said prescribed position prior to rotation of said second cam, for secondly permitting said spring-loaded rotation of said first cam from said first position to said prescribed position after rotation of said second cam commences, for thirdly inhibiting said spring-loaded rotation of said first cam from said prescribed position for a prescribed period of time during continued rotation of said second cam, and for fourthly permitting said spring-loaded rotation of said first cam from said prescribed position during continued rotation of said second cam after completion of said prescribed period of time; and a cam rotator coupled to said second cam for rotating said second cam.

2. A control mechanism as in claim 1 wherein said lead coupler is made from a material that conducts electricity.

3. A control mechanism as in claim 1 wherein said lead coupler is made from a material conducts an explosive reaction.

4. A control mechanism as in claim 1 wherein said cam rotator comprises:

a spring coupled to said second cam for spring-loading said second cam for rotation in said direction of rotation; and a governor coupled to said second cam for controlling release of said spring-loading.

5. A control mechanism as in claim 1 further comprising a stop for stopping said first cam when said first cam has rotated from said prescribed position to a second position different than each of said prescribed position and said first position.

6. A control mechanism, comprising:

a circular member having an axis of rotation and configured for spring-loaded rotation about said axis in a direction of rotation, said circular member defining a first peripheral shape in a first plane perpendicular to said axis and a second peripheral shape in a second plane parallel to said first plane, said circular member positioned between two leads which can conduct an energetic transmission therealong when coupled to one another;

a lead coupler made of a material capable of conducting said energetic transmission, said lead coupler coupled to said circular member, said lead coupler sized and shaped such that said two leads are coupled to one another by said lead coupler when said circular member achieves a prescribed position;

a cam configured for rotation and disposed adjacent to said circular member for firstly cooperating with said first peripheral shape of said circular member to maintain said circular member in a first position different than, said prescribed position prior to rotation of said cam and to permit said spring-loaded rotation of said circular member from said first position to said prescribed position as said cam rotates, for secondly cooperating with said second peripheral shape of said circular member to stop said spring-loaded rotation of said circular member at said prescribed position for a prescribed period of time during continued rotation of said cam, and for thirdly cooperating with said first peripheral shape of said circular member to again permit said spring-loaded rotation of said circular member from said prescribed position during continued rotation of said cam after completion of said prescribed period of time; and a driver coupled to said cam for rotating said cam in said direction of rotation.

7. A control mechanism as in claim 6 wherein said lead coupler is made from a material that conducts electricity.

8. A control mechanism as in claim 6 wherein said lead coupler is made from a material conducts an explosive reaction.

9. A control mechanism as in claim 6 wherein said driver comprises:

a spring coupled to said cam for spring-loading said cam for rotation in said direction of rotation; and a mechanical timer coupled to said cam to effect time-controlled release of said spring-loading.

10. A control mechanism as in claim 6 further comprising a stop for cooperating with one of said first peripheral shape and said second peripheral shape to stop said circular member when said circular member has rotated from said prescribed position to a second position different than each of said prescribed position and said first position wherein said lead coupler no longer couples said two leads to one another.

11. A control mechanism as in claim 6 wherein said first peripheral shape comprises a circle with a first protuberance extending therefrom in said first plane, and wherein said second peripheral shape comprises a circle with a second protuberance extending therefrom in said second plane, said first protuberance being angularly offset relative to said second protuberance such that said first protuberance leads said second protuberance when said circular member undergoes said spring-loaded rotation.

12. A control mechanism as in claim 11, wherein:

said cam has a first portion of constant radius $R_1$ that cooperates with said first protuberance to maintain said circular member in said first position as said cam starts to rotate in said direction of rotation;

said cam has a second portion of constant radius $R_2$ that follows said first portion with respect to said direction of rotation, said radius $R_2$ being less than said radius $R_1$ such that said second portion and said first protuberance can rotate by one another as said second portion opposes said first protuberance wherein said circular member undergoes said spring-loaded rotation to rotate in said direction of rotation;

said cam has a third portion of said radius $R_1$ residing on a plane coincident with said second plane, said third portion cooperating with said second protuberance to stop said circular member in said prescribed position for said prescribed period of time as said cam continues to rotate in said direction of rotation; and said cam has a fourth portion of said radius $R_2$ residing on said plane coincident with said second plane and following said third portion with respect to said direction of rotation such that said fourth portion and said second protuberance can rotate by one another as said fourth portion opposes said second protuberance wherein said circular member again undergoes said spring-loaded rotation to rotate in said direction of rotation.

13. A control mechanism as in claim 12 further comprising a stop for cooperating with one of said first protuberance and said second protuberance to stop said circular member when said circular member has rotated from said prescribed position to a second position different than each of said prescribed position and said first position wherein said lead coupler no longer couples said two leads to one another.

14. A control mechanism, comprising:

a circular member having an axis of rotation and configured for spring-loaded rotation about said axis in a direction of rotation, said circular member defining a first peripheral shape in a first plane perpendicular to said axis and a second peripheral shape in a second plane parallel to said first plane, said circular member positioned between two leads which can conduct an energetic transmission therealong when coupled to one another, said first peripheral shape being a circle with a first protuberance extending therefrom in said first plane, said second peripheral shape being a circle with a second protuberance extending therefrom in said second plane, said first protuberance being angularly offset relative to said second protuberance such that said first protuberance leads said second protuberance when said circular member undergoes said spring-loaded rotation;

a lead coupler made of a material capable of conducting said energetic transmission, said lead coupler coupled to said circular member, said lead coupler sized and shaped such that said two leads are coupled to one another by said lead coupler when said circular member achieves a prescribed position; and a controller for, in sequential fashion, engaging said first protuberance to maintain said circular member in a first position different than said prescribed position, disengaging said first protuberance to permit said spring-loaded rotation of said circular member from said first position to said prescribed position, engaging said second protuberance to stop said spring-loaded rotation of said circular member at said prescribed position and, after a prescribed period of time, disengaging said second protuberance to again permit said spring-loaded rotation of said circular member from said prescribed position.

15. A control mechanism as in claim 14 wherein said lead coupler is made from a material that conducts electricity.

16. A control mechanism as in claim 14 wherein said lead coupler is made from a material conducts an explosive reaction.

17. A control mechanism as in claim 14 further comprising a stop for cooperating with one of said first protuberance and said second protuberance to stop said circular member when said circular member has rotated from said prescribed position to a second position different than each of said prescribed position and said first position wherein said lead coupler no longer couples said two leads to one another.

* * * * *